US005428910A

United States Patent [19]

Gudefin et al.

[11] Patent Number: 5,428,910

[45] Date of Patent: Jul. 4, 1995

[54] STEAM IRON WITH INTERNAL AND EXTERNAL FLUID SUPPLY

[75] Inventors: Jacques Gudefin, Saint Priest; Denis Daulasim, Villeurbanne; Jean-Pierre Debourg, Lyons, all of France

[73] Assignee: SEB S.A., Selongey, France

[21] Appl. No.: 221,603

[22] Filed: Apr. 1, 1994

[30] Foreign Application Priority Data

Apr. 2, 1993 [FR] France ..... 93 03923

[51] Int. Cl.[6] ..... D06F 75/12; D06F 75/14

[52] U.S. Cl. ..... 38/77.6; 38/77.82

[58] Field of Search ..... 38/75, 77.3, 77.5, 77.6, 38/77.7, 77.82, 88, 96; 219/246, 247, 256, 259

[56] References Cited

U.S. PATENT DOCUMENTS

| | | | |
|---|---|---|---|
| 2,247,438 | 7/1941 | Gorton | 38/77.6 |
| 2,316,907 | 4/1943 | Wallace | 38/77.6 |
| 2,573,174 | 10/1951 | Bate | 38/77.6 |
| 2,620,576 | 12/1952 | Stevenson et al. | 38/77.3 |
| 2,661,552 | 12/1953 | Reichold | 38/77.6 |
| 2,744,344 | 5/1956 | Jepson | 38/77.6 |
| 2,851,050 | 9/1958 | Cissel et al. | 38/77.6 X |
| 2,883,778 | 4/1959 | Kistner | 38/77.6 |
| 3,130,507 | 4/1964 | Hoecker | 38/77.6 |
| 4,535,556 | 8/1985 | Cavalli | 38/77.6 |

FOREIGN PATENT DOCUMENTS

| | | | |
|---|---|---|---|
| 0493765A2 | 7/1992 | European Pat. Off. . | |
| 2583792 | 12/1986 | France . | |
| 2800767A1 | 4/1979 | Germany . | |
| 3-136699 | 6/1991 | Japan | 38/77.6 |

*Primary Examiner*—Clifford D. Crowder
*Assistant Examiner*—Ismael Izaguirre
*Attorney, Agent, or Firm*—Finnegan, Henderson, Farabow, Garrett & Dunner

[57] ABSTRACT

A steam iron including a vaporization chamber (2) connected by a water/steam supply device (8,11) to a flexible hose (9) extending from an external large-capacity reservoir(13). A device (5) regulates the water discharge that is also connected to the vaporization chamber (2), this discharge regulating device (5) being connected to an internal reservoir (4) incorporated in the iron (1).

16 Claims, 3 Drawing Sheets

STEAM IRON WITH INTERNAL AND EXTERNAL FLUID SUPPLY

BACKGROUND OF THE INVENTION

This invention relates to steam irons, and, more particularly to steam irons adapted for use with an external water/steam reservoir.

Steam irons that are connected to a large capacity, external water or steam reservoir by a flexible hose are known in the art. The reservoir may provide the iron with either water or steam, the latter being generated by a heater associated with the external reservoir. This arrangement permits a large capacity reservoir that is particularly useful in lengthy ironing sessions. Unlike standard irons with incorporated internal water reservoirs, the person using this iron does not have to fill the reservoir several times while ironing.

In spite of the advantages of such external reservoir irons, they are also inconvenient in that they are cumbersome and difficult to implement. Moreover, external reservoirs adapted to supplying steam to the iron must be heated quite a long time because of their large water storage capacity.

The above mentioned drawbacks are also a problem to a user wanting to iron only a single garment in a short period. The time it takes to implement an external reservoir iron is thus disproportionate to a very brief period of use.

Some irons are known, notably those described in U.S. Pat. No. 2,316,907, U.S. Pat. No. 3,130,507, and DE 2,800,767, which have an internal reservoir connected to an external supply. In these irons, however, the external supply replenishes only water to the internal reservoir. At best, this kind of arrangement is not suited to different kinds of ironing. Indeed, when an external supply is used, the vapor pressure of the supply is limited by the presence of the reservoir and drip regulation devices which, as described in U.S. Pat. No. 2,316,907, connect the reservoir to the vaporization chamber. Furthermore, the internal reservoir, located in the path connecting the external reservoir to the vaporization chamber, is not adapted to an external steam supply.

On the contrary, if, as described in U.S. Pat. No. 3,130,507, the internal reservoir is joined to the vaporization chamber by an injection device, such as a valve that is adapted to a highly-pressurized, large discharge water supply, the injection device is not adapted to the use of the internal reservoir alone because it cannot accommodate injection of water only by gravity feed.

SUMMARY OF THE INVENTION

The present invention has been made in view of the above circumstances and has as an object to overcome the above-mentioned drawbacks. Notably, an iron well suited to all types of ironing situations and to the needs of the user is provided.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the steam iron of the invention has a vaporization chamber connected by a water or steam supply device to a flexible hose extending to a large capacity external reservoir.

According to the invention, the iron also has a device to regulate the discharge of water from an internal reservoir that is also connected to the vaporization chamber, the regulation device being connected to the internal reservoir incorporated in the iron and which is separate from the supply device.

Thus, with the iron of this invention, the user can employ either the large capacity external reservoir for lengthy ironing sessions or the incorporated internal reservoir of lower capacity for short ironing sessions. The iron thus enables a flexible response to the needs of a user.

Moreover, when the external reservoir is not ready to supply steam, the user can rely on the internal reservoir in order to start ironing. This is particularly true for external reservoirs that supply steam and that need advance heating time.

In a preferred version of the invention, the flexible hose is joined detachably to the external reservoir. Implementation of the iron is thus simplified because the user can employ the iron only for short ironing sessions. Otherwise, one would further have to remove and replace the external reservoir, which is relatively burdensome.

In a beneficial version of the invention, a mounting block carrying the flexible hose is detachable from the iron, the flexible hose being connected to a supply device when the mounting block is attached to the iron.

The iron can thus be disconnected from the external reservoir by detaching the mounting block connected to one end of the flexible hose, the latter thus capable of being attached to the external reservoir in a definitive way. When the user does not wish to use the external reservoir, one thus avoids keeping the flexible hose attached to the iron and the attendant hindrance to user when ironing.

Other distinctive features and advantages of the invention are found in the subsequent description.

BRIEF DESCRIPTION OF THE DRAWINGS

The accompanying drawings, which are incorporated in and constitute a part of this specification illustrate embodiment(s) of the invention and, together with the description, serve to explain the objects, advantages and principles of the invention. In the drawings.

DETAILED DESCRIPTION OF THE PREFERRED EMBODIMENTS

Figure 1:
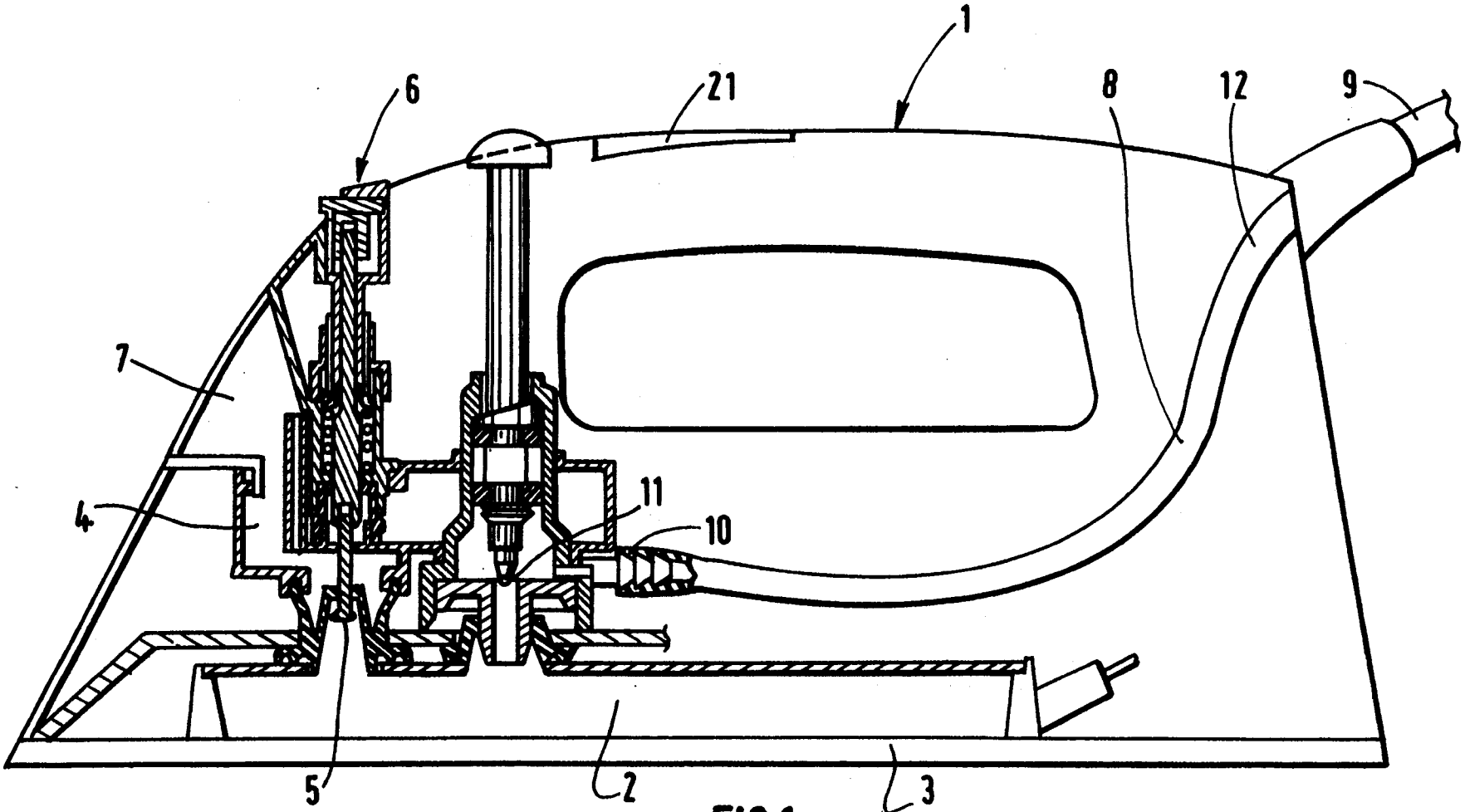
FIG. 1 is a cross-sectional view of the iron of the invention.

In FIG. 1, iron (1) houses vaporization chamber (2) located above the sole (3) of the iron. Iron (1) includes a device (8, 11) that supplies vaporization chamber (2) and is connected to a flexible hose (9), which extends from a large capacity external reservoir (13), seen in FIG. 3.

Supply device (8,11) consists of a conduit (8) having a first end (10) connected to vaporization chamber (2) by a gravitational supply device, such as a regulator valve (11), and a second end (12) connected to flexible hose (9).

Iron (1) also has an internal water reservoir (4) connected to vaporization chamber (2) by regulator device (5). The latter is, in conventional fashion, a drip system (5) activated by control (6) on iron (1). Reservoir (4) is supplied with water via opening (7), which is preferably located on the front of the iron.

Internal reservoir (4) is separate from supply conduit (8) that joins the external reservoir to the vaporization chamber (2).

The two lay-on circuits for water or steam are thus entirely separate from each other depending on whether they originate from the external reservoir (13) or from the internal reservoir (4). Thus, vaporization chamber (2) can be supplied either by water reservoir (4) integrated in iron (1), or by the external reservoir (13).

The external reservoir can be a water reservoir including a pump (not shown) adapted to supply flexible hose (9) with water. The water thus passes through flexible hose (9) and conduit (8) so it is subsequently supplied to vaporization chamber (2) according to a discharge regulated by valve (11).

The external reservoir can also include heating means adapted to vaporizing water in the external reservoir. The latter thus directly supplies the water in the external reservoir as steam to the iron.

Figure 2:
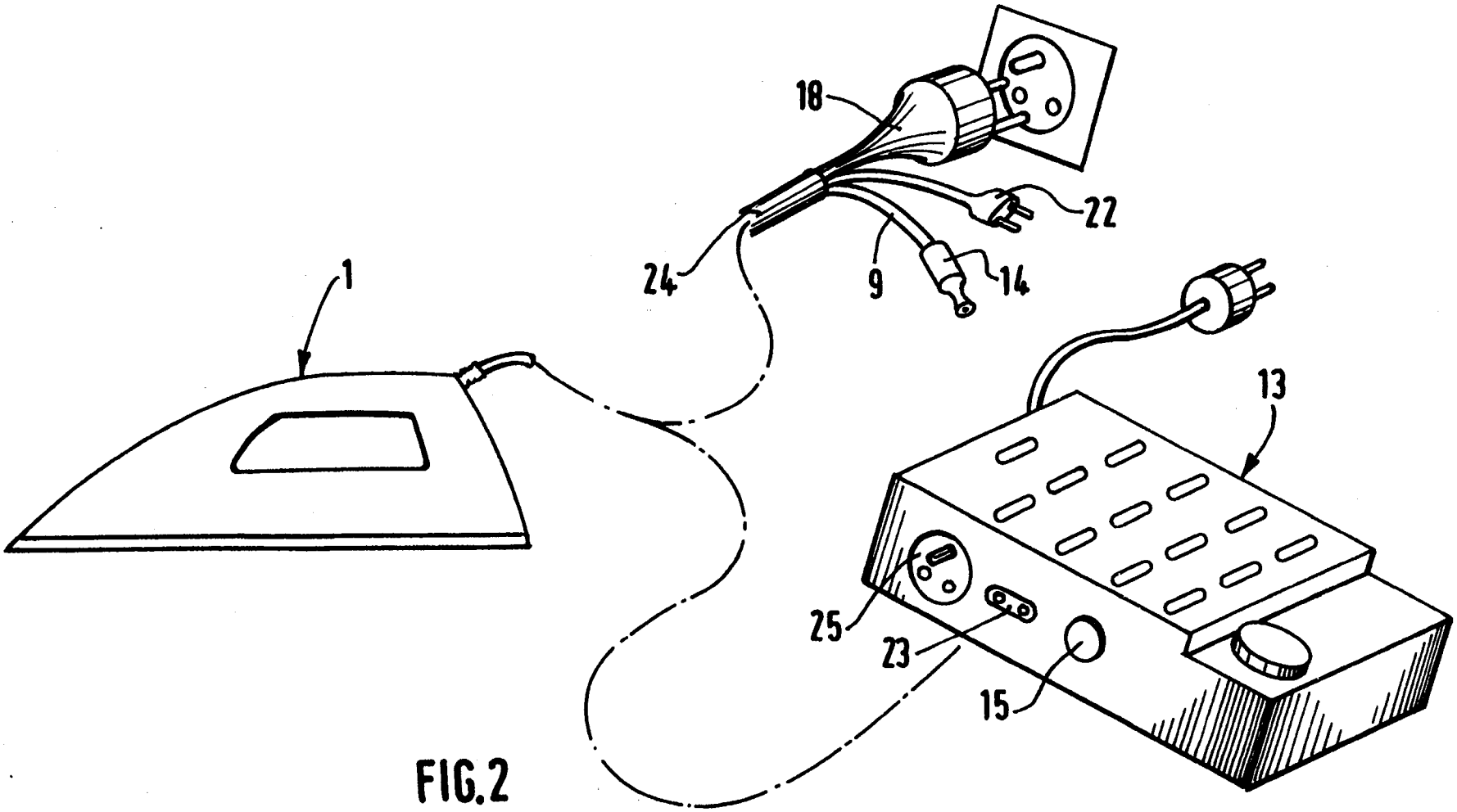
FIG. 2 is a simplified view of a first embodiment of the invention.

As shown in FIG. 2, and according to a first embodiment of the invention, flexible hose (9) is connected detachably to external reservoir (13) by a tubular detent fitting (14) fastened in exit opening (15) in the external reservoir (13). The detent fitting (14) makes it possible to plug and unplug iron (1) very easily to and from external reservoir (13).

When the user wants to iron a small amount of clothing, the user can unplug iron (1) from external reservoir (13) and use the internal reservoir (4), which greatly simplifies implementation and installation of iron (1).

As shown in FIG. 1, iron (1) also has a control means (21) connected by a cord and connector (22) to external reservoir (13). The control means (21) thus controls the external reservoir for the supply of water or steam through the flexible hose (9).

Control means (21) is preferably located on the handle of iron (1) so that when the user grabs iron (1) to iron clothes, he automatically controls the distribution of water or steam from the external reservoir. This supply is interrupted as soon as the iron is at rest and when the user no longer holds the handle of iron (1). As in FIG. 2, connector (22) is connected detachably to external reservoir (13), which includes a connection receptacle (23) and associated valve means (not shown).

Preferably, flexible hose (9), cord and connector (22), and the electric supply cord (18) of the electric circuit of iron (1) enter the iron within a single cord (24) in which they are all bound. This makes it possible to have only one cord (24) extend from iron (1) and to thus avoid the hindrance created by multiple, separate conduits and/or cords.

Preferably, external reservoir (13) includes an electric supply plug of the sort whereby flexible hose (9), connector (22), and electric supply cord (18) are all plugged into external reservoir (13).

Figure 3:
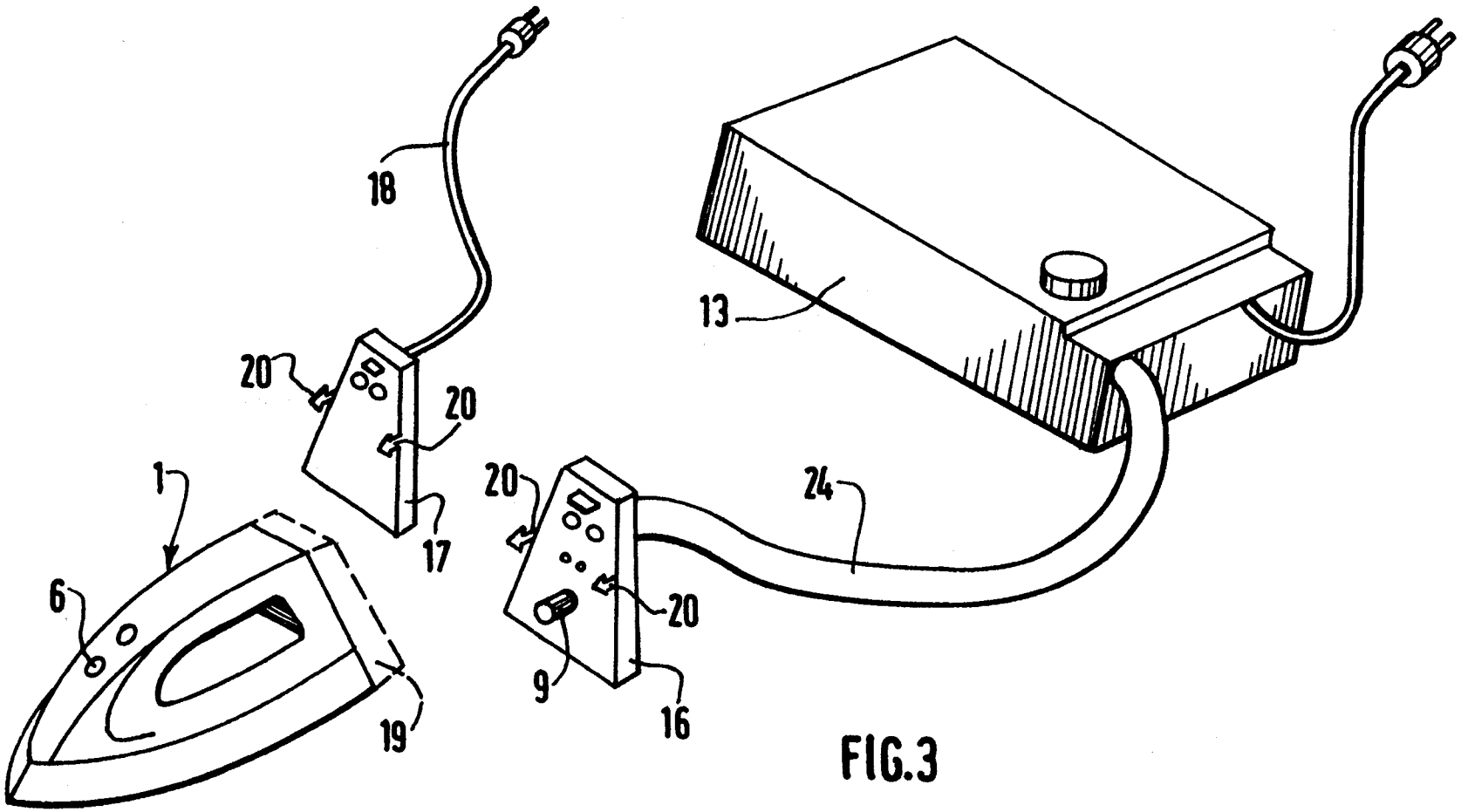
FIG. 3 is a simplified view of a second embodiment of the invention.

According to another embodiment of the invention shown in FIG. 3, a mounting block (16), carrying flexible hose (9) together with the control cord from the control means (21) and an electric power cord in a common cable (24), is releasably attached to the iron (1). Flexible hose (9) is connected to supply device (8, 11) when mounting block (16) is attached to the iron. A second mounting block (17) can be substituted for the first mounting block (16).

During short ironing sessions, then, flexible hose (9) can be eliminated from iron (1), thus avoiding the hose impeding the iron's movements.

The first and second mounting blocks (16, 17) preferably include an electric supply cord, such a cord (18) being part of the second mounting block (17) and connected to an electric circuit of iron (1) when the second mounting block (17) is attached to the iron. The cable (24) includes a similar power cord extending to the first mounting block (16).

This electric supply cord (18) makes it possible, in a known manner, to furnish the energy necessary for the elements of iron (1) that equip vaporization chamber (2).

As in FIG. 3, the first and second mounting blocks (16, 17) comprise heel (19) of the iron. The two detachable mounting blocks (16,17) thus fit onto the rear of iron (1) and are kept on iron (1) by detent means (20).

In the second embodiment in FIG. 3, the first detachable mount (16) includes the cord and connector (22) which is connected to external reservoir (13) and is connected to control (21) of the iron when the first mounting block (16) is attached to the iron. Mounting block (16) also includes flexible hose (9).

During long ironing sessions with a steam-generating external reservoir (13), the user can plug in only electric supply cord (18) to plug (25) of the external reservoir (13) and start his ironing owing to the extra reservoir (4) integrated in the iron while waiting until the steam generator is hot enough to use.

Iron (1) of this invention, when used with a heating external reservoir (13), allows immediate ironing without waiting for the generator to preheat.

During short ironing sessions, one may, in the first embodiment of the invention shown in FIG. 2, plug supply (18) to a standard sector plug, avoiding a cumbersome extensions of hoses and cables from external reservoir (13).

Similarly, in the second embodiment in FIG. 3, during brief ironing sessions, mounting block (16) is replaced by mounting block (17), which only has electric supply cord (18) that is plugged into a standard sector plug. Installation of the iron by the user is thus simplified for short ironing sessions.

The examples of plugging in the iron to external reservoirs are non-limiting.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A steam iron comprising:

means defining a vaporization chamber;

a water/steam supply device connected to said means and for connection to a large capacity external reservoir to supply water or steam to the vaporization chamber;

an internal water reservoir;

a device to regulate water discharge from the internal reservoir to the vaporization chamber, said water discharge regulation device incorporated in said iron and being independent of said supply device in the supply of water to the vaporization chamber.

2. An iron according to claim 1, comprising a flexible hose detachably connected at least to said supply device or said external reservoir.

3. An iron according to claim 2, comprising a tubular detent fitting at one end of the flexible hose to connect the one end of the hose to the external reservoir.

4. An iron according to any one of claims 2 or 3, comprising a mounting block detachably connected to the iron, the flexible hose being supported by the mounting block for connection to the supply device when the mounting block is connected to the iron.

5. An iron according to claim 4, comprising a second mounting block to be substituted for the first mounting block.

6. An iron according to claim 5, wherein the iron includes an electric circuit and wherein the first and second mounting blocks include an electric supply cord connected to the electric circuit when the first mounting block or the second mounting block is attached to the iron.

7. An iron according to claim 5, wherein the first and second mounting blocks each constitute a heel of the iron.

8. An iron according to claim 4, wherein the mounting block also includes a connector coupled to the external reservoir and connected to control means for controlling the supply of water or steam from the external reservoir, said control means being located on the iron and operative when the mounting block is attached to the iron.

9. An iron according to claim 1 comprising control means connected by a coupling to the external reservoir and adapted to control the supply of water/steam from the external reservoir to said supply device.

10. An iron according to claim 9, wherein the coupling is detachably connected to said external reservoir.

11. An iron according to claim 8, wherein the flexible hose, the connector and an electric supply cord enter the iron in a single cable.

12. An iron according to claim 1 wherein the external reservoir includes an electric supply plug.

13. An iron according to claim 1 wherein the external reservoir is a water reservoir including a pump adapted to supply the supply device with water.

14. An iron according to claim 1 wherein the external reservoir includes heating means for vaporizing water contained in said external reservoir.

15. An iron according to 1, wherein the regulating device is a drip system activated by a control located on the iron.

16. An iron according to claim 1, wherein the supply device comprises a conduit with a first end coupled to the vaporization chamber by means of a regulation valve and a second end connected to the external reservoir via a flexible hose.

* * * * *

UNITED STATES PATENT AND TRADEMARK OFFICE

CERTIFICATE OF CORRECTION

PATENT NO. : 5,428,910

DATED : July 4, 1995

INVENTOR(S) : GUDEFIN et al.

It is certified that error appears in the above-indentified patent and that said Letters Patent is hereby corrected as shown below:

Claim 15, column 6, line 26, before "l" insert --claim--.

Signed and Sealed this

Seventeenth Day of October, 1995

*Attest:*

*Attesting Officer*

BRUCE LEHMAN

*Commissioner of Patents and Trademarks*